US007578266B2

(12) United States Patent
Venturi

(10) Patent No.: US 7,578,266 B2
(45) Date of Patent: Aug. 25, 2009

(54) VARIABLE DISPLACEMENT AND/OR VARIABLE COMPRESSION RATIO ENGINE

(75) Inventor: Stéphane Venturi, Roiffieux (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 54 days.

(21) Appl. No.: 11/960,798

(22) Filed: Dec. 20, 2007

(65) Prior Publication Data

US 2009/0159051 A1 Jun. 25, 2009

(30) Foreign Application Priority Data

Dec. 20, 2006 (FR) ..... 06 11234

(51) Int. Cl.
*F02B 75/04* (2006.01)

(52) U.S. Cl. ..... 123/48 B; 123/78 BA

(58) Field of Classification Search ..... 123/48 R, 123/48 B, 78 R, 78 BA, 78 E, 78 F
See application file for complete search history.

(56) References Cited

U.S. PATENT DOCUMENTS 680,237 A 8/1901 Eudelin
926,564 A 6/1909 Hollopeter
4,917,066 A 4/1990 Freudenstein et al.
5,163,386 A * 11/1992 Schechter ..... 123/48 B

FOREIGN PATENT DOCUMENTS

EP 0 248 655 12/1987
GB 228706 11/1923
GB 2 312 242 A 10/1997

* cited by examiner

*Primary Examiner*—Noah Kamen
(74) *Attorney, Agent, or Firm*—Antonelli, Terry, Stout & Kraus, LLP.

(57) ABSTRACT

The present invention relates to an internal-combustion engine comprising at least one cylinder (10) in which a piston (14) slides between a top dead center (TDC) and a bottom dead center (BDC) under the action of a connecting rod (20) of axis XX and a crankshaft (38) controlling the displacement of the piston under the effect of an articulated linking system (26) allowing variation of the engine displacement and/or compression ratio. The articulated linking system comprises a shift lever (26) mounted to pivot around an articulation axle (46) and is displaceable in translation in at least one direction by displacement control means (52, 52V). The shift lever comprises a porthole (44) within which the axle is housed and is connected by one (24) of its ends to the connecting rod and by the other (28) end to a link (32) connected to the crankshaft. Shift lever (26) comprises a slider (78) carrying articulation axle (46) and cooperating with opening (44) of the lever.

20 Claims, 7 Drawing Sheets

VARIABLE DISPLACEMENT AND/OR VARIABLE COMPRESSION RATIO ENGINE

BACKGROUND OF THE INVENTION

The present invention relates to a variable compression ratio and/or displacement internal-combustion engine and to a method allowing to obtain one or the other or both variation types and also relates to direct or indirect fuel injection engines, notably of diesel or gasoline type, with or without spark ignition.

DESCRIPTION OF THE PRIOR ART

As it is well known to the person skilled in the art, it is useful to vary the engine compression ratio and/or displacement according to the conditions of use.

In the case of a compression ratio variation, the latter allows increasing the engine efficiency, notably at low engine speed and low loads, or to prevent the appearance of engine knock that may damage the engine. Generally, the compression ratio of an engine is defined as the ratio between the volume formed by the dead volume of the combustion chamber plus the volume scavenged by the piston between the bottom dead center (BDC) and the top dead center (TDC) thereof and the dead volume of this chamber.

Engine displacement variation allows modification of the amount of air allowed into the combustion chamber and therefore to use the engine at high loads over a large part of its range of use. The engine displacement is considered to be the volume scavenged by the piston between the bottom dead center (BDC) and the top dead center (TDC) thereof.

As better described in French patent application number 2,807,105, it is well known to use devices allowing variation of the compression ratio by varying the volume of the combustion chamber at the piston top dead center, this volume being more commonly referred to as dead volume.

These devices generally include a connecting rod whose small end is connected to a joint with one end of a link used for varying the distance between the piston pin and the axle of the crankpin controlling displacement of the piston in a reciprocating rectilinear displacement motion within the cylinder. This link comprises a body carrying an articulation axle with the crankpin and another end subjected to the action of a control means that controls the swinging of this link around the crankpin axle. Swinging allows changing the inclination of the body of this link in relation to its longitudinal axis and thus to modify the distance between the piston pin and the crankshaft axle.

Other variation devices, such as those described in documents GB Patent 2 312 242, U.S. Pat. No. 4,917,066, EP Patent 0 248 655, GB Patent 228 706, and US patent applications 926 564 or 680 337, comprise an articulated linking system with a shift lever swinging around an articulation axle and displaceable in translation in a direction through displacement control means. This shift lever comprises a opening in which this articulation axle is housed and it is connected by one of its ends to the connecting rod and by the other end to a link connected to the crankshaft.

One major drawback of these devices is that they require high-power control means to allow the connecting rod length variation.

Furthermore, these devices of the prior art do not allow ready and reliable modification of the compression ratio without changing the engine displacement.

Besides, the position of the articulation axle in the opening is difficult to determine depending on the desired variation.

The present invention aims to overcome the aforementioned drawbacks by means of a user-friendly device of simple design.

SUMMARY OF THE INVENTION

The present invention therefore relates to an internal-combustion engine comprising at least one cylinder in which a piston slides between a top dead center and a bottom dead center under the action of a connecting rod of axis XX and a crankshaft controlling the displacement of the piston under an effect of an articulated linking system allowing variation of the engine displacement and/or compression ratio, the articulated linking system comprising a shift lever mounted pivotably around an articulation axle and displaceable in translation in at least one direction by a displacement control means, the shift lever comprising a hole within which the axle is housed and being connected by one of its ends to the connecting rod and by the other end to a link connected to the crankshaft, characterized in that the shift lever comprises a slider carrying the articulation axle and cooperating with the opening of the lever.

The engine can comprise means for controlling the displacement in translation of the shift lever in a first direction and means for controlling the displacement in translation of the shift lever in a direction orthogonal to the first direction.

The articulation axle can be displaceable in translation in an orthogonal direction to the first direction of the shift lever.

The shift lever can comprise means for locking the translation of the articulation axle in the opening.

Advantageously, the displacement means can comprise a jack with its rod.

The shift lever can comprise inclined grooves cooperating with projections carried by the articulation axle and running across the slider through slots.

The displacement control means can comprise an eccentric carrying a bore for receiving the articulation axle.

The displacement control means can comprise two eccentrics arranged in parallel in relation to one another and between which the shift lever is placed with its articulation axle.

The eccentric can comprise a control means for rotation around its axis.

Preferably, the control means can comprise an axial bar.

The longitudinal axis of the connecting rod and the longitudinal axis of the shift lever can form a non-zero angle.

The invention also relates to a method of varying displacement and/or compression ratio of an internal-combustion engine comprising at least one cylinder in which a piston slides between a top dead center and a bottom dead center under the action of a connecting rod of axis XX and a crankshaft controlling the displacement of the piston under effect of an articulated linking system, the method providing the articulated system with a shift lever mounted pivoting around an articulation axle, in connecting the shift lever by one of its ends to the connecting rod and by another end to a link connected to the crankshaft, and in displacing in translation the shift lever in a first direction to modify shift lever arms in relation to the articulation axle in order to change the engine displacement and/or in displacing in translation the shift lever in an orthogonal direction to the first direction so as to modify the compression ratio, and displacing translation of the shift lever in a vertical direction to change a height between the articulation axle and a fixed point of the engine to modify the engine compression ratio.

BRIEF DESCRIPTION OF THE DRAWINGS

Other features and advantages of the invention will be clear from reading the description hereafter, given by way of non limitative example, with reference to the accompanying figures wherein.

DETAILED DESCRIPTION

Figure 1:
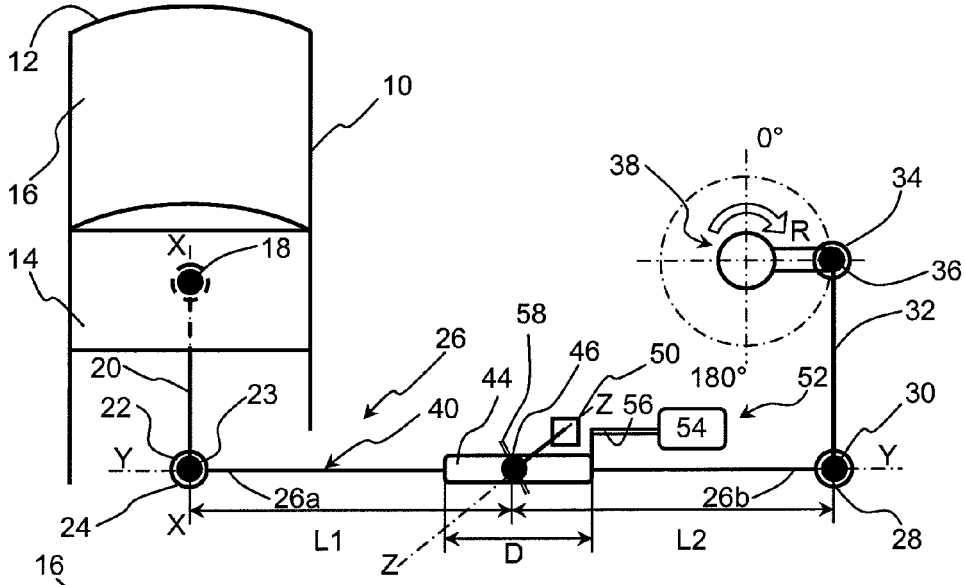
FIG. 1 is a diagram showing an engine according to the invention in a nominal average configuration of the engine displacement.
Figure 2:
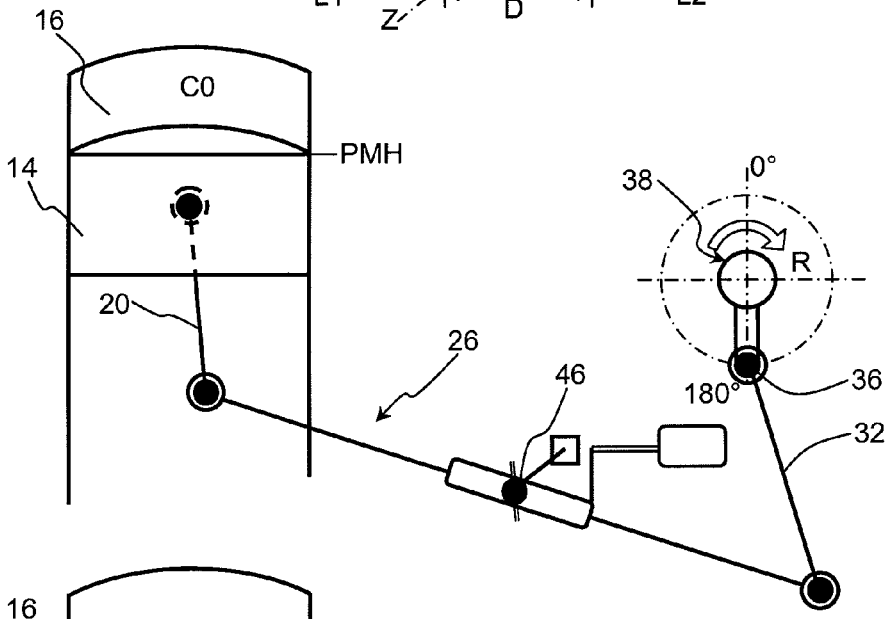
FIGS. 2 and 3 are diagrams illustrating the engine of FIG. 1 with a piston position at top dead center and bottom dead center respectively.
Figure 3:
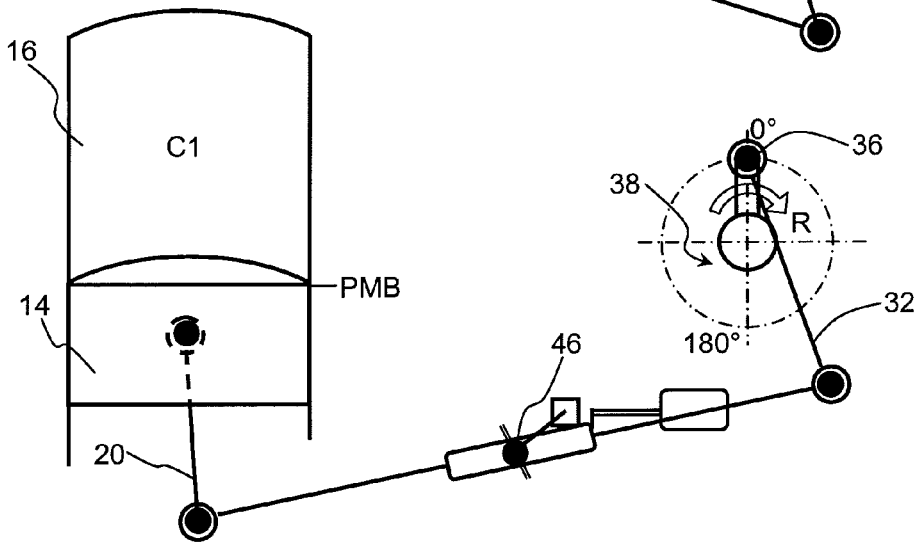

FIGS. 1 to 3 show an internal-combustion engine comprising at least one cylinder 10 whose upper end is closed by a cylinder head 12. This cylinder contains a piston 14 defining a combustion chamber 16 with the lateral wall of the cylinder, the cylinder head and the upper part of the piston. This piston can slide, in a reciprocating rectilinear motion, within the cylinder between an upper position referred to as Top Dead Center (TDC), where it is the closest to the cylinder head by defining a dead volume C0 in this chamber (FIG. 2), and a lower position referred to as Bottom Dead Center (BDC), where it is the furthest from the cylinder head by forming an active volume C1 in the chamber (FIG. 3).

The piston is connected by an articulated piston axle 18 to the small end of a connecting rod 20 whose big end 22 is connected by an articulation axle 23 to the end 24 of a lever 26 referred to as shift lever in the description hereafter. This shift lever comprises another end 28 that is connected to an articulation axle 30 carried by one end of a link 32 whose other end 34 is articulated on the pin 36 of a crank such as the convention crankshaft 38 with which any engine is usually equipped.

Thus, the shift lever associated with the link forms an articulated linking system between the connecting rod and the crankshaft.

It should be noted that general axis XX of the piston passing through the axis of piston 18 and the axis of connecting rod small end 22 and general axis YY of the shift lever passing through the axes of ends 24 and 28 of the shift lever form a non-zero angle so as to ensure suitable operation of the assembly and to minimize stresses between the piston and the cylinder wall. Similarly, the longitudinal axis of link 32 forms a non-zero angle with axis YY of the shift lever.

The shift lever comprises between its two ends a supporting body 40 comprising, preferably in the median region thereof, a longitudinal opening 44 extending between the two ends of the shift lever over a distance D and running through the thickness of the body 40. The opening contains an articulation axle or pivot pin 46 of axis ZZ substantially perpendicular to axis YY, which is immovably connected to a fixed part of engine 50 such as the crankcase block. The shift lever can move linearly along axis YY, that is in a horizontal motion with reference to FIG. 1, under the action of any known control means. By way of non limitative example, as illustrated in the drawings, these means 52 comprise a horizontal jack 54 whose rod 56 is connected by any known means to body 40 of the shift lever without hindering swinging of the lever around the pivot pin.

In a preferred but in no way obligatory way, locking means 58 can be provided between pivot pin 46 and opening 44 so as to lock this pivot in the opening in the desired position. These means can be of any known type, such as a lock pin running through the longitudinal walls of the opening and the pivot.

During operation of the engine, in a nominal average position as illustrated in FIG. 1, piston 14 is in a median position between the TDC and the BDC thereof, and crankpin 36 of the crankshaft is also arranged in a median position between its 0° position and its 180° position. Pivot 46 is in a median position (D/2) within opening 44 where it is locked by locking means 58. This position of the pivot thus allows defining a position of the two lever arms on the shift lever, a lever arm 26*a* of length L1 between the articulation axle of end 24 of the lever and axis ZZ of pivot 46, and another lever arm 26*b* of length L2 between this pivot axle and the articulation axle of the other end 28 of the shift lever.

Under the effect of the rotation of crankshaft 38 as shown by arrow R, crank pin 36 changes from the median position of FIG. 1 to the 180° position of FIG. 2, which substantially corresponds to the TDC of piston 14. In this configuration, shift lever 26 has revolved around pivot 46 in a clockwise direction under the action of link 32 and it has driven, by means of connecting rod 20, piston 14 to its TDC while leaving a dead volume C0 in combustion chamber 16.

While continuing its rotation, still in the direction shown by arrow R in the drawings, crankshaft 38 drives crankpin 36 from its 180° position to its 0° position, as shown in FIG. 3. During this motion and from the configuration illustrated in FIG. 2, link 32 causes the shift lever to swing in an anticlockwise direction around pivot 46 until it reaches the position illustrated in FIG. 3. During this motion of the lever, the latter drives, by means of rod 20, piston 14 in a descending motion from the TDC illustrated in FIG. 2 to the BDC while creating an active volume C1 in combustion chamber 16.

Thus, the nominal displacement Cn of this engine is the difference between active volume C1 and dead volume C0 (Cn=C1−C0). Of course, to obtain the displacement of a multi-cylinder engine, the nominal displacement will be multiplied by the total number of cylinders.

Figure 4:
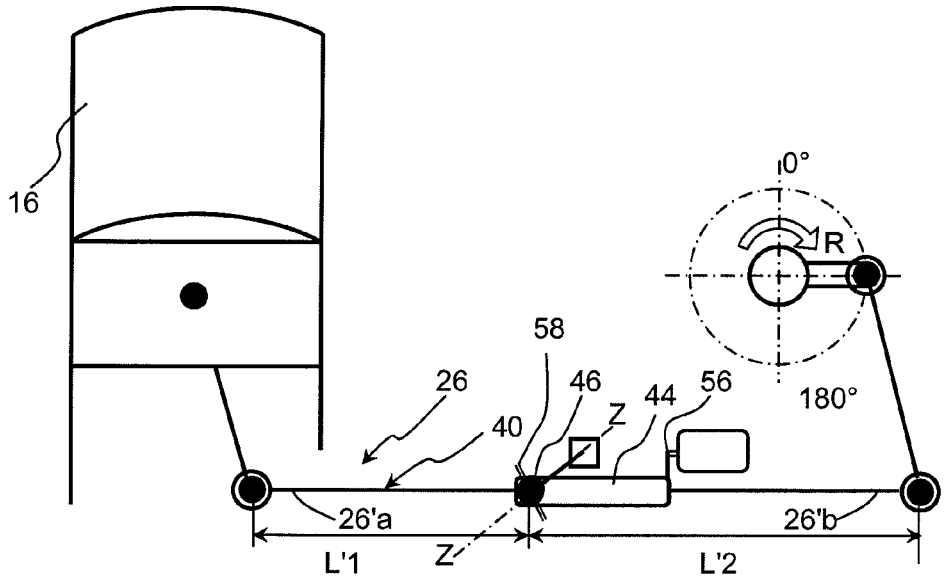
FIG. 4 is a diagram showing the engine of FIG. 1 in an engine displacement reduction average configuration.

If it is desired to reduce the nominal displacement of the engine (FIGS. 4 to 6) and from the nominal position illustrated in FIG. 1 where the shift lever is in a substantially horizontal position, pivot 46 is unlocked from opening 44 by means 58, the jack is actuated so that its rod 56 causes translation, in a substantially horizontal rectilinear motion, of shift lever 26 to the right of FIG. 4. At the end of this translation motion, the pivot is located at the end of the opening that is the closest to the cylinder by causing a modification of the lever arms of the shift lever, without modifying the orientation of the lever. Thus, as shown in FIG. 4, length L'1 of lever arm 26 a is shorter than length L1 of FIG. 1 and length L'2 of lever arm 26'*b* is greater than length L2. Once this position is reached, the pivot pin is locked in the opening by locking means 58.

Figure 5:
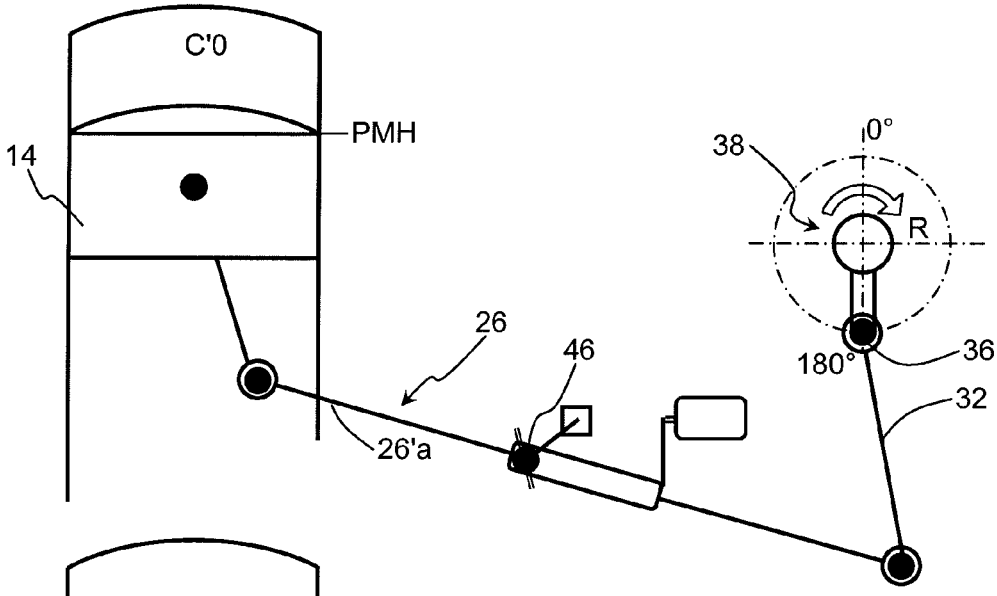
FIGS. 5 and 6 are diagrams illustrating the engine of FIG. 4 with a piston position at top dead center and bottom dead center respectively.

During motion of crankshaft 38 in a clockwise direction from its median position of FIG. 4 to its 180° position of crankpin 36 of FIG. 5, link 32 controls shift lever 26 so that it revolves around pivot 46 in a clockwise direction. Under the effect of this swinging, piston 14 reaches its TDC (FIG. 5) while leaving in the combustion chamber a dead volume C'0 that is greater than volume C0, considering essentially that lever arm 26 a is smaller than lever arm 26*a*.

Figure 6:
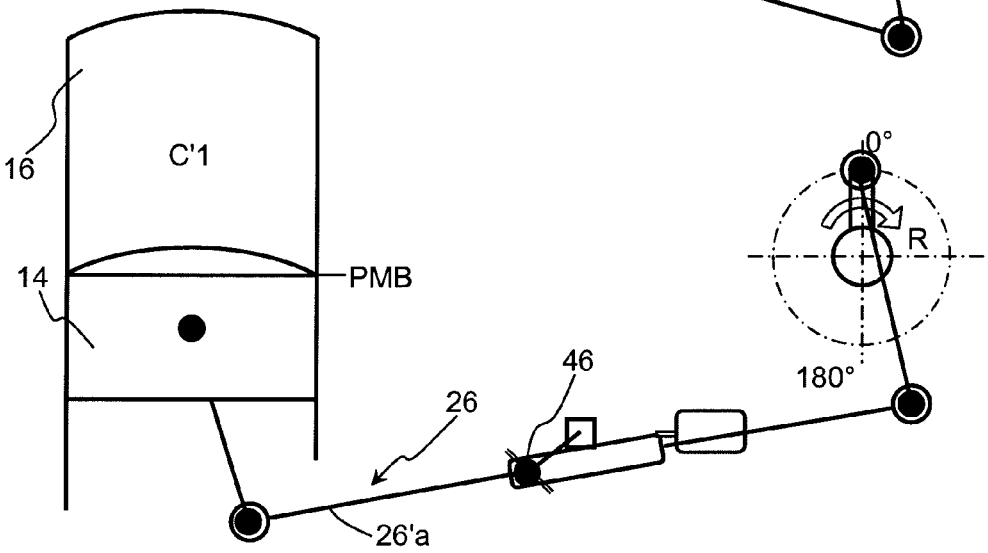

As the motion of the crankpin continues from its 180° position to its 0° position shown in FIG. 6, shift lever 26 revolves, from the configuration of FIG. 5, around pivot 46 in an anti-clockwise direction while driving piston 14 to its BDC and leaving in chamber 16 a volume C'1 that is smaller than volume C1 of FIG. 3. Similarly, this reduction of active volume C'1 is due to the fact that lever arm 26'*a* is smaller than lever arm 26*a*.

The reduced engine displacement (Cr) therefore corresponds to the difference between C'1 and C'0 (Cr=C'1−C'0) and this displacement is far smaller than the nominal displacement of FIGS. 1 to 3.

Figure 7:
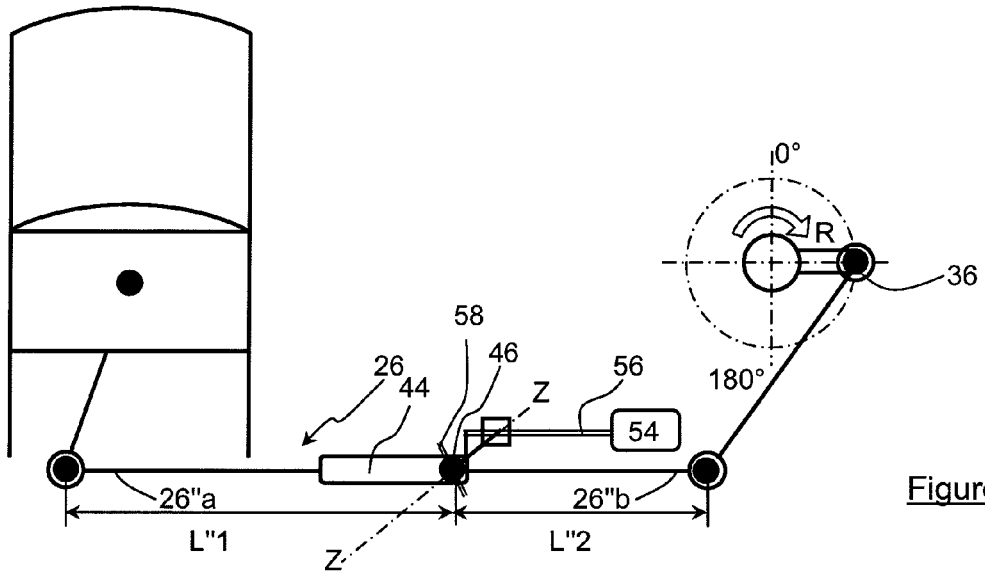
FIG. 7 is a diagram showing an engine of FIG. 1 in an engine displacement increase average configuration.
Figure 8:
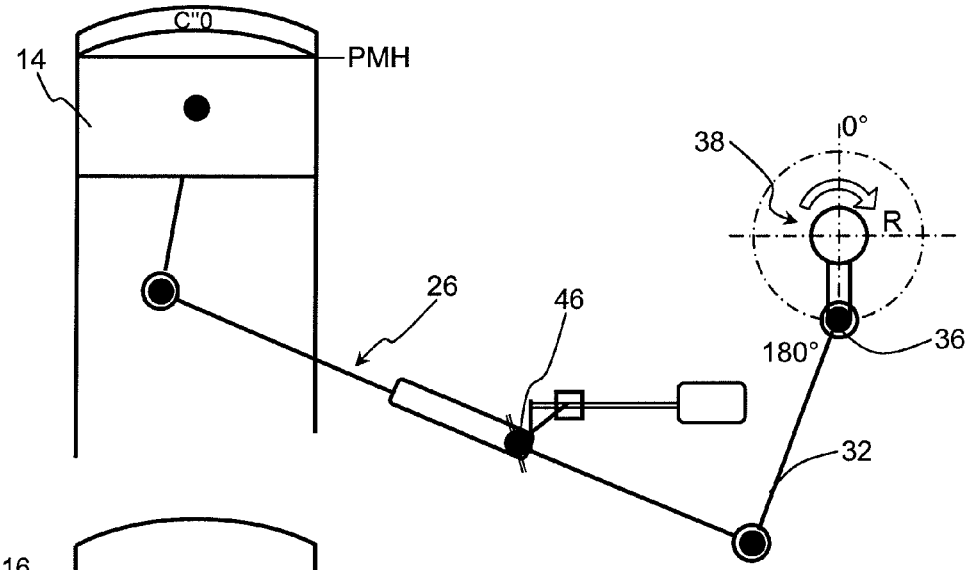
FIGS. 8 and 9 are also diagrams illustrating the engine of FIG. 7 with a position of the piston at top dead center and bottom dead center.
Figure 9:
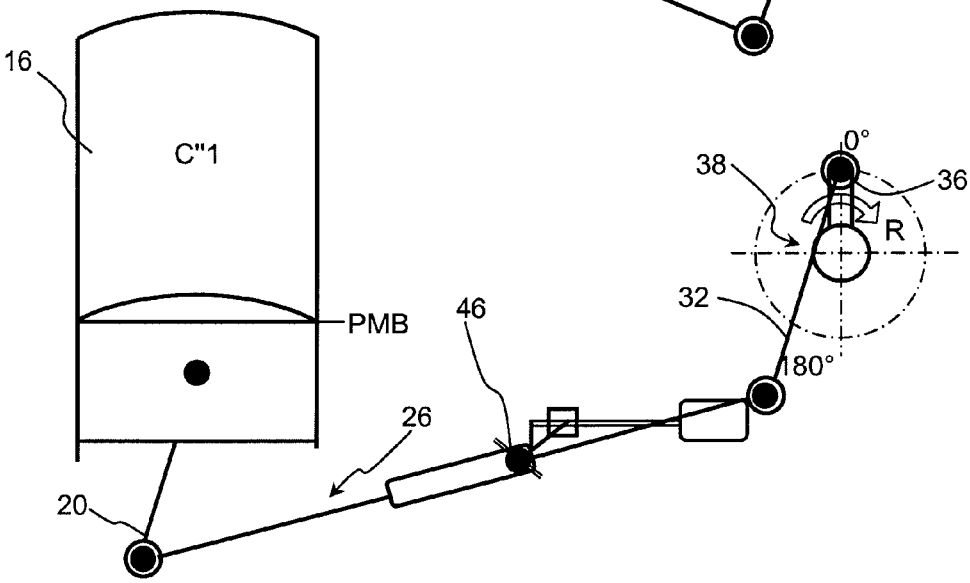

On the other hand, when it is desired to increase the engine displacement, displacement of shift lever 26 just has to be controlled in the opposite direction to FIG. 4 so as to increase lever arm 26" a and to decrease lever arm 26"b (FIGS. 7 to 9).

Jack 54 therefore controls rod 56 so that it causes a horizontal translation motion of the shift lever to the left of FIG. 7 until this pivot is positioned at the end of opening 44 that is the furthest from the cylinder. This position of the pivot causes a change in the lever arms of the shift lever (FIG. 7) with a length L"1 of lever arm 26"*a* that is greater than length L1 of FIG. 1, and a length L"2 of lever arm 26"*b* that is smaller than length L2 of FIG. 1. Once this position reached, the pivot is locked in this position in relation to the opening by means of locking means 58.

Upon motion of the crankshaft to the 180° position of crankpin 36 from the median position of FIG. 7, shift lever 26 revolves around pivot 46 in a clockwise direction under the action of link 32. Under the effect of rod 20, piston 14 is brought to its TDC (FIG. 8) with a dead volume C"O that is smaller than dead volume C0 of FIG. 2.

In the continuity of the motion of crankshaft 38 as shown by arrow R with a displacement of crankpin 36 from its 180° position to its 0° position, shift lever 26 revolves around pivot 46 under the effect of link 32 in an anti-clockwise direction until it reaches its BDC. Once this BDC reached, an active volume C'1 that is greater than volume C1 of FIG. 3 remains in combustion chamber 16.

The increased engine displacement (Ca) is therefore greater than the nominal displacement (Cn) because C"1 is greater than C1 and C"0 is smaller than C0.

Figure 10:
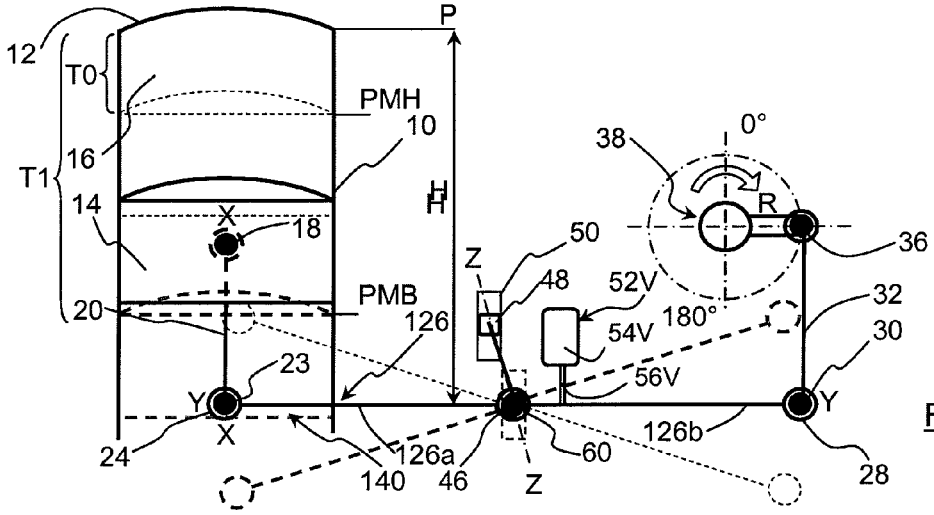
FIG. 10 is a diagrammatic view showing an engine according to the invention for an initial average configuration of the compression ratio.
Figure 11:
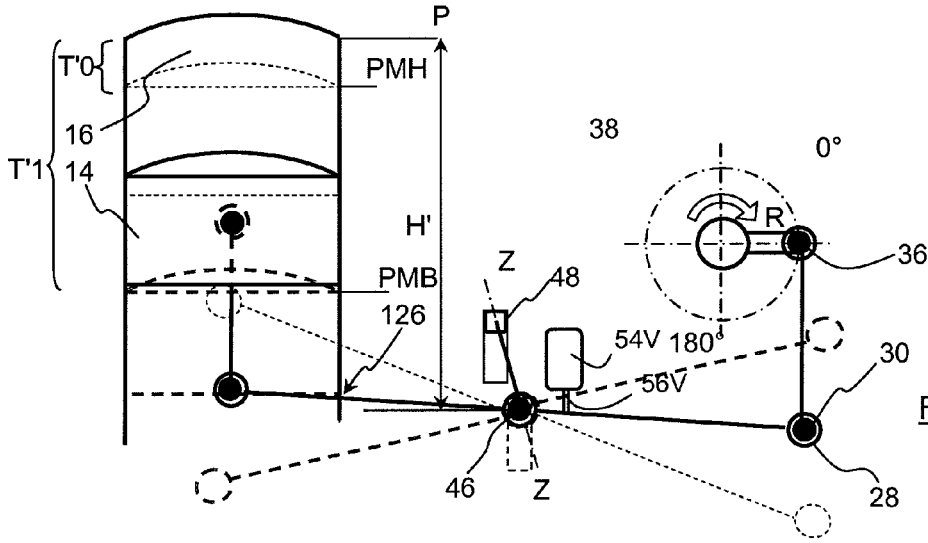
FIG. 11 is a diagrammatic view showing the engine of FIG. 10 in a compression ratio increase configuration.
Figure 12:
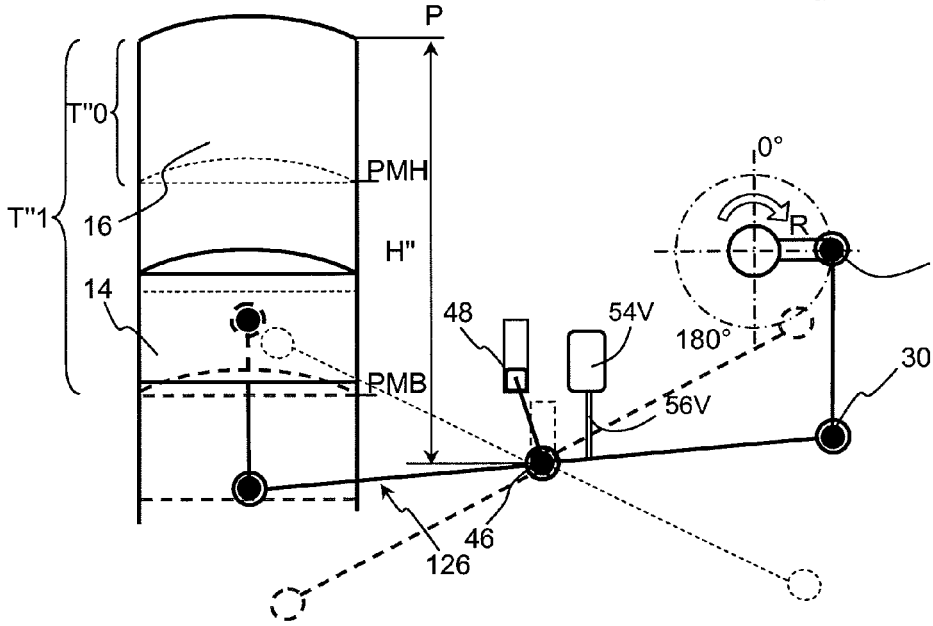
FIG. 12 is also a diagrammatic view showing the engine of FIG. 10 for a compression ratio reduction configuration.

FIGS. 10 to 12 show another example of the invention wherein the compression ratio of the engine can be modified with essentially the same elements as those described in connection with FIGS. 1 to 9.

FIG. 10 is an illustration of the engine in a nominal average position with, in full line, piston 14 in a median position between its TDC and its BDC, as crankpin 36 of the crankshaft between its 0° position and its 180° position.

The internal-combustion engine comprises at least one cylinder 10, a cylinder head 12 and a piston 14 allowing limiting a combustion chamber 16. This piston slides, in a reciprocating rectilinear motion, in the cylinder between its TDC and its BDC.

The piston is connected by an articulated piston axle 18 to connecting rod 20 that is itself connected by an axle 23 to the end 24 of a shift lever 126 whose other end 28 is connected by an articulated axle 30 to link 32 articulated on crankpin 36 of crankshaft 38.

The shift lever comprises between its two ends a body 140 provided with a bearing 60 receiving a pivot 46 of axis ZZ. Advantageously, this pivot is mobile in translation in a vertical motion, in connection with FIG. 10, in relation to a fixed part 50 of the engine, but stationary in relation to body 140 of the lever. This pivot thus allows defining two lever arms of fixed dimensions that can be identical or different, a lever arm 126*a* between end 24 of the shift lever and the axle of the pivot, and a second lever arm 126*b* between the other end 28 of the lever and this pivot axle.

This pivot is advantageously placed on a sole 48 sliding on the fixed part of engine 50, such as the crankcase block. As already mentioned in connection with FIGS. 1 to 9, the vertical linear displacement of the pivot/lever assembly can be provided by any known control means 52V, such as a vertical jack 54V whose rod 56V is connected to the lever. The pivot housed in bearing 60 of body 140 allows rotation of the shift lever around pivot 46 without any translation displacement possibility for this pivot in body 140.

Of course, without departing from the scope of the invention, a layout similar to the arrangement shown in the previous drawings can be provided, with a bearing 60 in a form of a vertical porthole and a pivot placed in this porthole and immovably connected to a fixed part of the engine. In this configuration, only the shift lever is controlled by control means 52V providing vertical linear displacement thereof.

In the nominal compression ratio configuration (Tn) as illustrated in FIG. 10, axis ZZ of pivot 46 is located at a distance H from a fixed point of the engine which, by way of example, is considered in the plane P passing through the head gasket between the top of the cylinder and the cylinder head.

Thus, the piston defines a dead volume T0 in combustion chamber 16 when this piston is at its TDC, as shown by the dotted line of FIG. 10, and an active volume T1 when this piston is at its BDC (shown by the thick dotted line in FIG. 10). The nominal compression ratio (Tn) is thus T1/T0.

When the compression ratio of the engine is to be increased, as shown in FIG. 11, the shift lever and therefore pivot 46 associated with sole 48 are displaced by rod 56V of jack 54V to the top of this figure. As a result of this translation motion, shift lever 126 revolves around axle 30 of its end 28 in a clockwise direction while driving piston 14 in an upward displacement. Height H' between fixed point P and axis ZZ of pivot 46 is therefore smaller that the height H defined above. Thus, when crankpin 36 reaches its 180° position starting from the median position of FIG. 11, piston 14 defines at its TDC (dotted line in FIG. 11) a dead volume T'0 of combustion chamber 16 that is smaller than volume T0 in FIG. 10. As the rotating motion of the crankpin continues until it reaches the 0° position, the piston reaches its BDC (thick dotted line in FIG. 11) under the action of the swing of the shift lever in an anti-clockwise direction around pivot 46 with a volume T'1 that is smaller than volume T1, but with a volume scavenged by the piston (T'1-T'0) that is substantially identical to that of FIG. 10. Consequently, the compression ratio (T'1/T'0) of the engine of FIG. 11 is greater than that of FIG. 10.

On the other hand, if the compression ratio of the engine is to be decreased, the configuration of FIG. 12 has to be obtained, where shift lever 126, pivot 46 and its sole 48 are displaced in translation by rod 56V of jack 54V to the bottom of this figure by causing lever 126 to revolve around axle 30 in an anti-clockwise direction and piston 14 to move downwards. Height H" between fixed point P and pivot 46 is consequently greater than height H of the nominal compression ratio of FIG. 10. In the 180° position of crankpin 36, piston 14 at the TDC defines (dotted line in FIG. 12) a dead volume T"0 of the combustion chamber that is greater than volume T0 of FIG. 10. In the situation of the piston at the BDC (thick dotted line in FIG. 12) with a 0° position of the crankpin, this piston defines in combustion chamber 16 a volume T"1 that is greater than volume T1 but with a volume scavenged by the piston (T"1-T"0) that is substantially identical to that of FIG. 10. The compression ratio (T"1/T"0) of the engine of FIG. 12 is therefore lower than that of FIG. 10.

Figure 13:
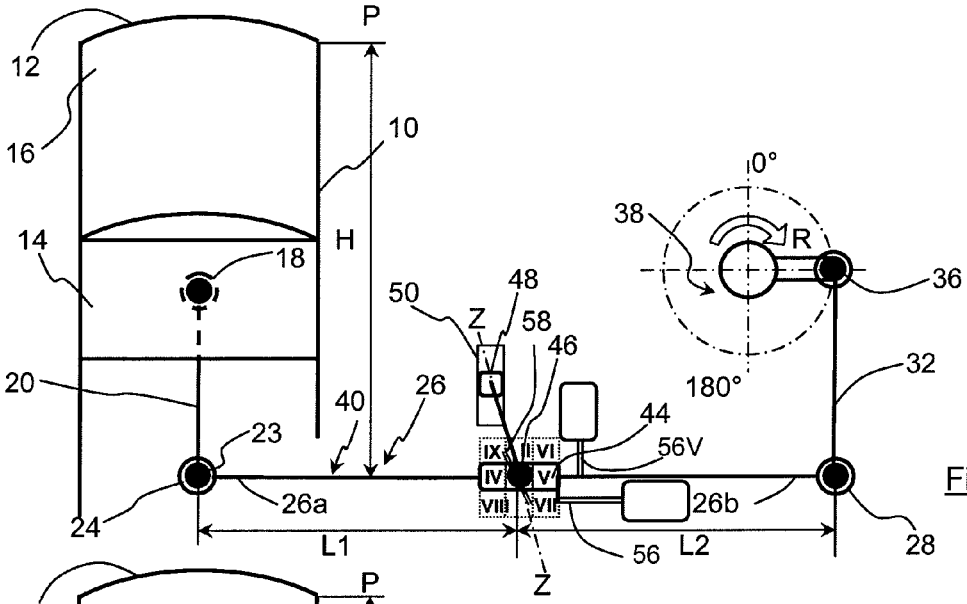
FIG. 13 shows a diagram of the engine according to the invention in an initial configuration for an engine displacement variation as well as a compression ratio variation.
Figure 14:
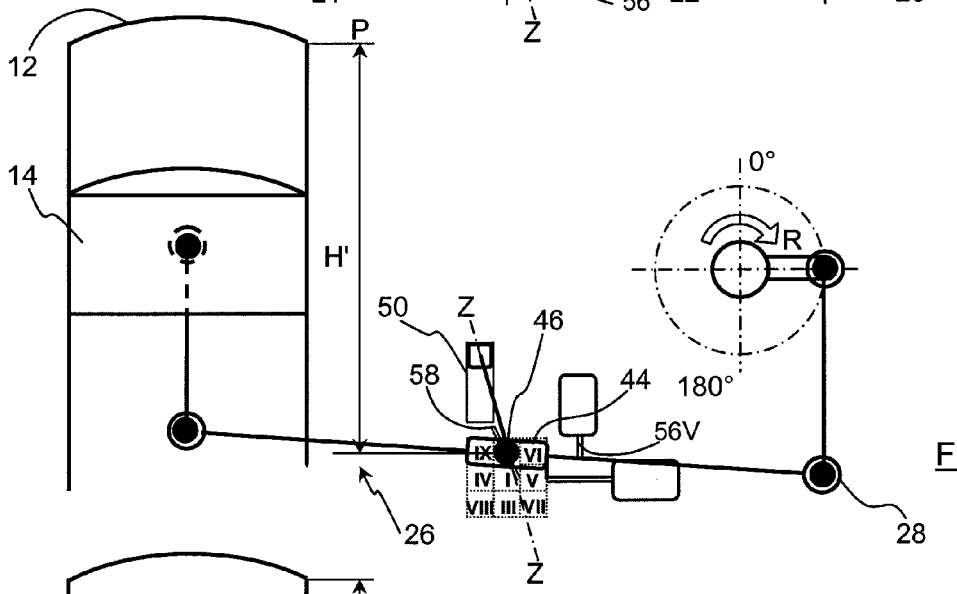
FIG. 14 shows the engine of FIG. 13 for a compression ratio increase.
Figure 15:
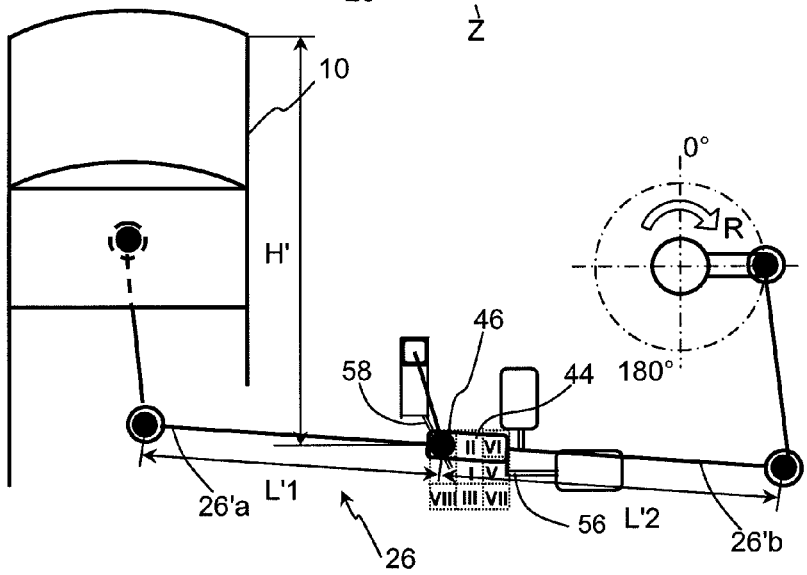
FIG. 15 is a diagram of the engine of FIG. 13 with a compression ratio increase and an engine displacement reduction.

FIGS. 13 to 15 illustrate a combination between the engine displacement variation possibility of FIGS. 1 to 9 and the compression ratio variation possibility of FIGS. 10 to 12 while keeping nearly all the elements of these types of variation.

In the example illustrated in FIG. 13, the engine comprises the same elements as those of FIGS. 1 to 9, with at least one cylinder 10, a cylinder head 12, a piston 14 defining a combustion chamber 16 and sliding, in a reciprocating rectilinear motion, in the cylinder between the TDC and the BDC thereof, a connecting rod 20 connected by an axle 23 to the end 24 of a shift lever 26 whose other end 28 is connected to one end of a link 32 whose other end 34 is articulated on crankpin 36 of a crankshaft 38.

As described above in connection with FIGS. 1 to 9, the shift lever comprises between its two ends a body 40 provided with a longitudinal opening 44 in which is housed a pivot pin 46 of axis ZZ mounted on a sole 48 sliding on a fixed part 50 of the engine. Advantageously, locking means 58 between pivot 46 and opening 44 are provided for locking in translation this pivot in the porthole.

Shift lever 26 is, in the case of FIGS. 13 to 15, controlled as regards its displacement in translation in two substantially orthogonal directions, a first substantially horizontal direction and a second substantially vertical direction when considering these figures.

These linear displacements are provided by any known control means. By way of non limitative example, these means comprise two jacks with a horizontal jack and its rod 56, as described above in connection with FIGS. 1 to 9, for the horizontal displacement, and a vertical jack with its rod 56V for the vertical displacement, as illustrated in FIGS. 10 to 13.

It is thus possible to achieve the various compression ratio and/or engine displacement variation configurations below, as referenced in FIGS. 13 to 15:

I—Nominal compression ratio and nominal engine displacement

II—Increase of the compression ratio alone

III—Decrease of the compression ratio alone

IV—Decrease of the engine displacement alone

V—Increase of the engine displacement alone

VI—Increase of the compression ratio and increase of the engine displacement

VII—Decrease of the compression ratio and increase of the engine displacement

VIII—Decrease of the compression ratio and decrease of the engine displacement

IX—Increase of the compression ratio and decrease of the engine displacement

Thus, in the nominal configuration I (FIG. 13), the engine has a nominal compression ratio (Tn) that corresponds to that of FIG. 10 with a height H in relation to a fixed point P of the engine and a nominal engine displacement (Cn) similar to the displacement illustrated in FIG. 1 with a lever arm 26*a* of the shift lever of length L1 and another lever arm 26*b* of length L2.

In configuration II (FIG. 14) corresponding to a compression ratio increase, pivot pin 46 is locked or remains locked by means 58 in opening 44 in a central position corresponding to the position of FIG. 1. Rod 56V of the jack is actuated in retracted position so as to displace in an upward vertical translation motion the shift lever and the pivot with its sole in relation to fixed part 50. This action allows causing lever 26 to revolve around its end 28 in a clockwise direction, thus bringing piston 14 closer to cylinder head 12 and reducing the height of axis ZZ of pivot 46 in relation to fixed point P in a height H'. In this configuration, the shift lever follows the method of operation described in connection with FIG. 11 by obtaining a decrease in the compression ratio of the engine.

From this configuration II, it is possible to either obtain in addition an engine displacement increase with a position of pivot 46 according to configuration VI or a decrease of this displacement by placing the pivot in configuration IX, as illustrated in FIG. 15.

To reach this configuration IX, locking means 58 are actuated to unlock pivot 46 in opening 44. Rod 56 of the jack is actuated so as to act upon lever 26 in order to translate it in a horizontal motion to the right of FIG. 15 while driving it away from cylinder 10 until the pivot meets with the end of the porthole that is the closest to this cylinder. Once this position is reached, pivot 46 is locked in translation in opening 44 by locking means 58, thus generating a lever arm 26'*a* of length L'1 and a lever arm 26'*b* of length L'2.

In this configuration, the running of the engine is identical to the mode described in connection with FIGS. 4 to 6 while providing a displacement decrease in addition to the compression ratio increase.

It is thus possible, by means of the invention, to vary either the compression ratio or the displacement, and to associate a compression ratio variation with an engine displacement variation.

FIGS. 16 to 19 illustrate an embodiment example of shift lever 26 and of the pivot, as well as the lever displacement control means.

Figure 16:
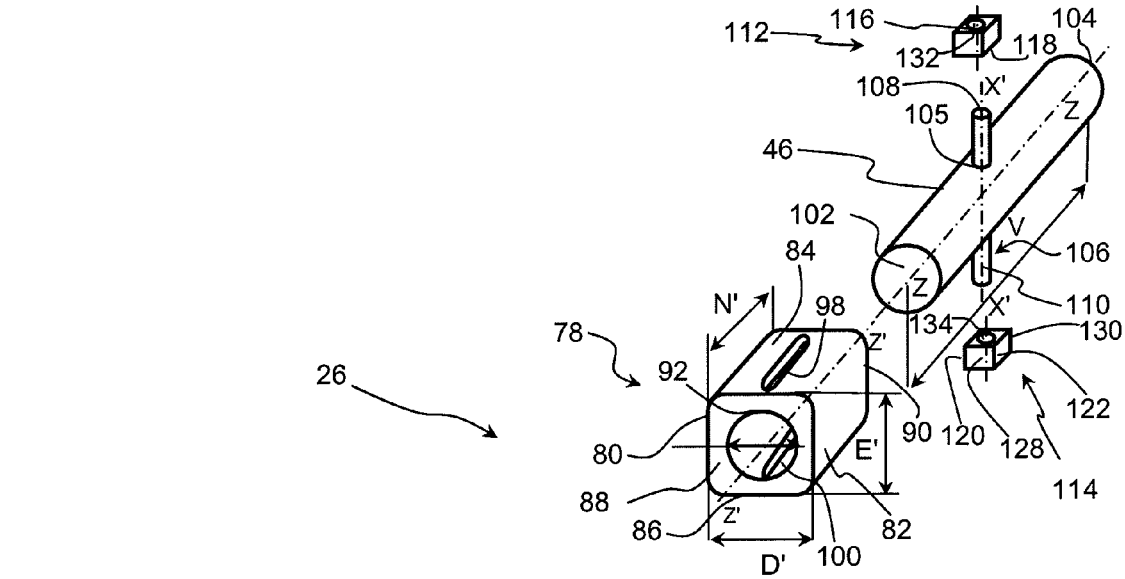
FIG. 16 is an exploded view showing an embodiment example of one of the elements of the engine according to the invention.
Figure 16:
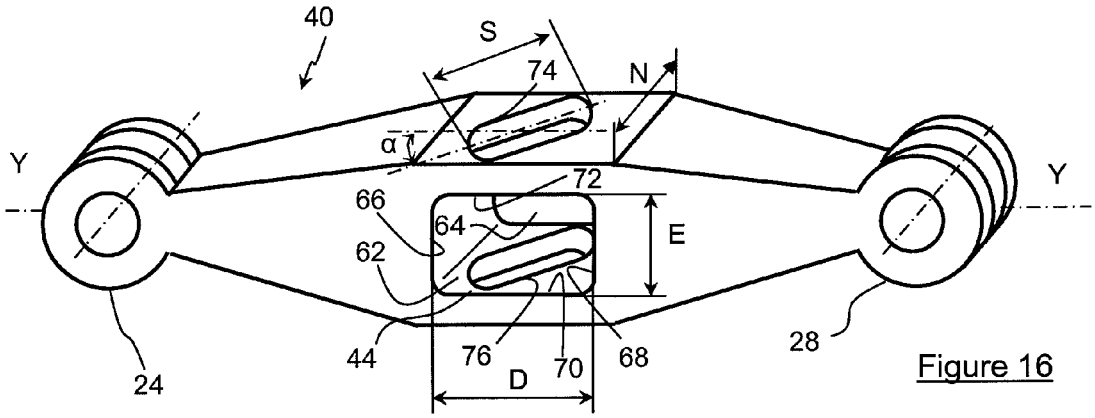
Figure 17:
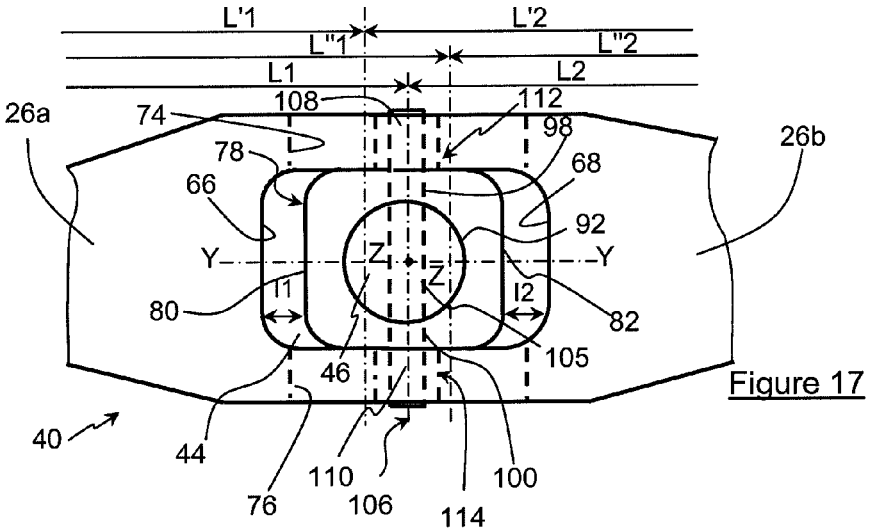
FIG. 17 is a partial front view of the element of FIG. 16.

In FIGS. 16 and 17, shift lever 26 comprises an elongate body 40 of axis YY with a first end 24 and a second end 28. An elongate opening 44 of substantially rectangular section, of extent D and of height E, is provided in the median region of body 40 by running through this body and having the two vertical open faces 62 and 64 at a distance N in the front and rear part of this lever, as shown in FIG. 16. This opening comprises two lateral faces 66 and 68 at a distance D from one another and perpendicular to axis YY, as well as two horizontal faces 70 and 72 at a distance E from one another and substantially perpendicular to the lateral faces 66 and 68. Oblong grooves 74 and 76 of general axis inclined by an angle $\alpha$ to axis YY are provided opposite one another on the upper and lower parts of body 40 while running through horizontal faces 70 and 72. The extent of each groove is provided in such a way that it is contained in each horizontal face of the porthole.

This opening is designed to house a slider 78 of rectangle plate shape and of height E' substantially equal to height E of this opening 44, of longitudinal extent D' smaller than extent D of the porthole and of depth N' substantially equal to distance N between the two open faces 62 and 64 of the opening. This slider thus comprises two lateral faces 80, 82 at a distance D', two horizontal faces 84, 86 at a height E' and two front faces 88, 90 at a distance N' from one another. Advantageously, this slider is made of a material allowing its sliding in opening 44.

The slider is provided with a bore 92 running right through this slider and whose axis Z'Z' is substantially orthogonal to the front faces 88, 90 while being at an equal distance from the vertical 80, 82 and horizontal lateral faces 84, 86. This slider is also provided on the upper and lower horizontal parts with two slots 98, 100 whose length is shorter than the depth of the slider. These slots are located opposite one another and they run through the horizontal parts prior to opening into bore 92. As can be seen in FIG. 16, slots 98 and 100 have directions substantially identical to axis Z'Z' by being placed at an equal distance between lateral faces 80 and 82.

A cylindrical pivot 46 of circular section substantially identical to bore 92 is provided sliding in this bore. This pivot comprises a length V between its two end faces 102 and 104 that is greater than the depth of slider 78. This pivot is also equipped with a hole 105 of axis X'X' substantially perpendicular to the longitudinal axis ZZ of this pivot. This hole is designed to receive a cylindrical stick 106 running therethrough by forming two projections 108 and 110. Advantageously, this stick has a diameter that is slightly smaller than the width of slots 98, 100 of the slider so as to allow these projections to slide in these slots. The projections are intended to receive two glide shoes 112, 114 as explained in the description below. These glide shoes are advantageously of square parallelepipedic shape with two horizontal plane faces 116, 118, two lateral faces 120, 122 of a distance substantially equal to the width of grooves 74, 76, and two front faces 128, 130. Each glide shoe is provided with a vertical bore 132, 134 opening onto the two horizontal faces 116 and 118 and of a diameter that is slightly smaller than that of the projections so as to be able to revolve around these projections.

All these elements are assembled so as to obtain an assembly as illustrated in FIG. 17. Slider 78 is therefore placed in opening 44 of shift lever 26 in such a way that slots 98 and 100 are located opposite grooves 74 and 76 with axis Z'Z' of bore 92 perpendicular to axis YY of the shift lever. Pivot 46 is then introduced coaxially into bore 92 with such a layout that hole 105 is arranged opposite the grooves and the slots. Stick 106 is introduced through the grooves, the slots and the hole so that the projections 108 and 110 are arranged in grooves 74 and 76 and the stick is locked in pivot 46, notably by clamping. Finally, glide shoes 112 and 114 are mounted on the projections in such a way that the lateral faces of these glide shoes can slide in the grooves and that the lower horizontal faces rest on this slider 78. Of course, these glide shoes are axially locked on the projections while being able to revolve circumferentially thereon by any known means, such as circlips arranged at the ends of the projections.

The assembly illustrated in FIG. 17 is in a nominal position corresponding to that of FIG. 1 or 13, where the pivot is in a median position (D/2) in opening 44 while leaving a free space I1 and I2 between lateral faces 66 and 80 and 68 and 82 of the slider and of the opening. In this position, projections 108 and 110 are positioned in the middle of length S of grooves 74 and 76 and in the middle of the length of slots 98 and 100. In this position, the shift lever has a lever arm 26*a* of length L1 between axis ZZ of pivot 46 and the articulation axle of the end, and another lever arm 26*b* of length L2 between this pivot axle and the articulation axle of end 28.

Figure 18:
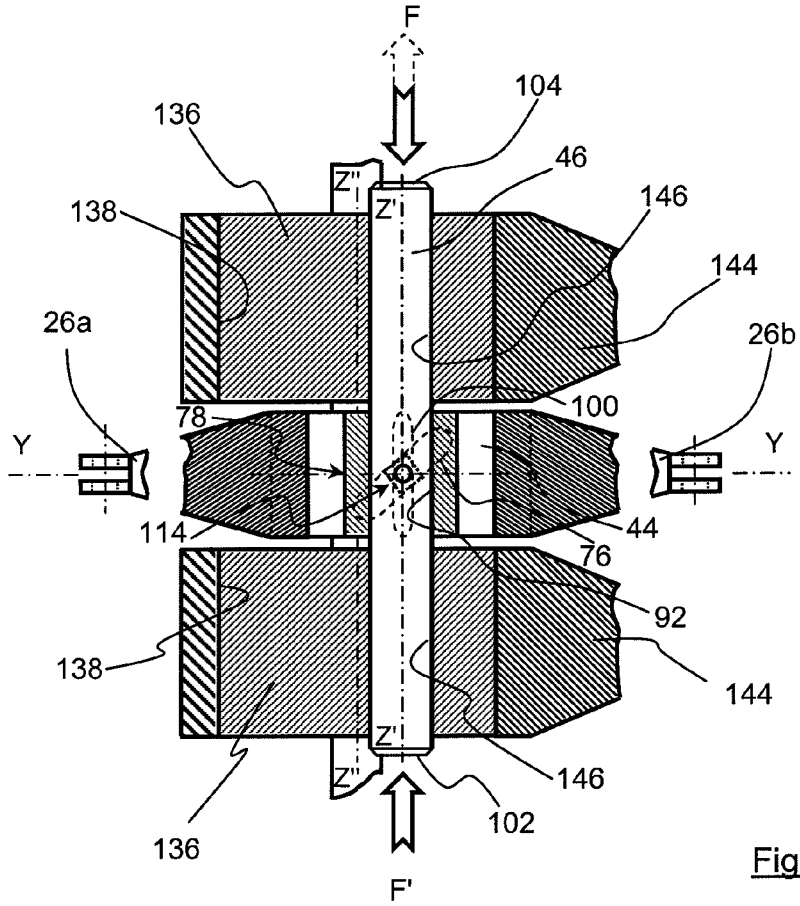
FIG. 18 is a partial cross-sectional view of part of the elements of the engine according to the invention as diagrammatically shown in FIG. 13.

During operation and, for better understanding, in connection with FIG. 18, lever arm 26*a* can be reduced to a length L'1 and lever arm 26*b* can be increased to a length L'2 to decrease the engine displacement as diagrammatically shown in FIG. 4. To reach this layout, a stress such as the action of a jack rod is exerted on one of the end faces 102 and 104 of this pivot 46 and in its axial direction (arrows F or F' in FIG. 18).

Thus, a thrust action on the rear face 104 of pivot 46 along arrow F causes axial displacement thereof in slider 78 in a forward motion as shown in FIG. 17. Under the effect of the cooperation of glide shoes 112 and 114 in inclined grooves 74 and 76, the shift lever moves on the slider housed in opening 44 to the right (considering FIG. 17) in a horizontal translation motion until lateral face 66 of the porthole and lateral face 80 of the slider are in contact, thus eliminating free space I1. During this motion and considering the presence of slots 98 and 100 in which projections 108 and 110 slide, this slider undergoes no forward motion. At the end of this horizontal translation motion, axis ZZ of pivot 46 is at a distance L'1 from end 24 of the lever that is shorter than nominal distance L1 and at a distance L'2 from the other end 28 greater than nominal distance L2. This allows, as described above in connection with FIGS. 4 to 6, to reduce the engine displacement.

If the displacement of this engine is to be increased either from the nominal position of the assembly or from the displacement reduction position described above, an action just has to be exerted in the opposite direction on pivot 46. A thrust action on front face 102 of pivot 46 along arrow F' (or a tractive action on rear face 104) therefore causes axial displacement thereof along axis ZZ in a backward motion in relation to FIG. 17. During this motion, the cooperation of glide shoes 112, 114 in inclined grooves 74, 76 causes displacement of the lever and of the pivot to the left of FIG. 17 until empty space 12 disappears through contact of lateral face 68 of the porthole with lateral face 82 of the slider. In this position, the pivot axle is at a distance L"1 from its end 24 that is greater than length L1 and at a distance L"2 of its end 28 that is shorter than length L2. Thus, the engine displacement can be increased as explained in connection with FIGS. 7 to 9.

Of course, one skilled in the art will take steps to calculate the lengths of the grooves and their inclinations $\alpha$ so as to define the extents of spaces I1 and I2 necessary for the desired displacement variations.

Figure 19:
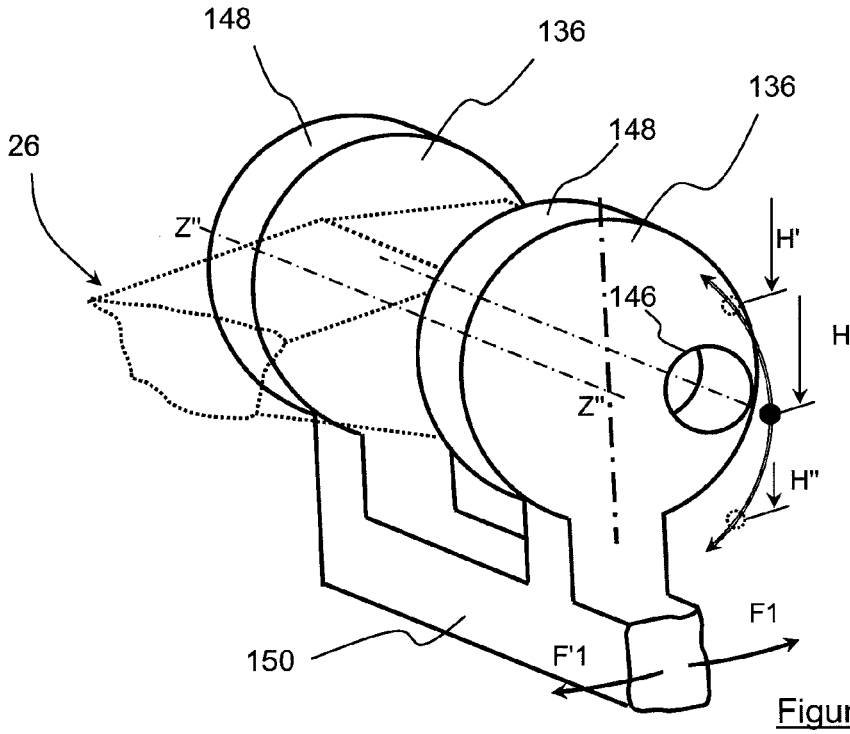
FIG. 19 is a partial perspective view of constituents of the element of FIG. 18.

FIGS. 18 and 19 illustrate a compression ratio variation example that can be combined with the engine displacement variation, as already illustrated in FIGS. 13 to 15.

This compression ratio variation is carried out by means of an eccentric disc 136 which revolves around its axis Z'Z' whose direction is identical to that of axis Z'Z' of pivot 46. This eccentric is placed in a circular housing 138 carried by a fixed part 144 of the engine such as a lug from the engine block. This eccentric carries, at a distance from axis Z"Z", a bore 146 of axis substantially parallel to axis Z"Z" and of diameter substantially equal to the diameter of pivot 46 so as to allow rotation and sliding of the pivot in this bore. Advantageously, as shown in FIGS. 18 and 19, a second eccentric 136 and its support 144, identical and parallel to the first one, are provided while leaving a sufficient space necessary for housing shift lever 26. These two eccentrics are linked to one another at one point of their peripheral surface 148 by an axial bar 150 so as to drive the two eccentrics 136 simultaneously in rotation around axis Z"Z".

After placing the eccentrics in the housings with a coaxiality of the two bores 146, shift lever 26 with its slider housed in opening 44 is placed in the space between the two eccentrics so that its axis YY is substantially orthogonal to axis Z"Z" and that axis Z'Z' of the slider is coaxial to that of bores 146. Pivot 46 whose length V is greater than the distance between the inner faces of the eccentrics is then introduced into bore 146 of one of the eccentrics, bore 92 of the slider and bore 146 of the other eccentric 136 to reach the position of FIG. 18. Stick 106 and glide shoes 112 and 114 are then set in place as mentioned above.

In the nominal position (FIG. 19) corresponding to the position shown in FIGS. 10 and 13, axis ZZ of pivot 46, that merges with the axis of bores 146, is at a height H of a fixed point of the engine.

In order to increase the compression ratio, an action is exerted on the bar as shown by arrow F1 by causing partial rotation of eccentrics 136 around axis Z"Z" and a displacement of bores 146 and of pivot 46 around this axis in an anti-clockwise direction. This allows a motion of the entire shift lever towards the fixed point of the engine. At the end of this rotation, axis ZZ of pivot 46 is at a height H' of the fixed point that is smaller than height H and corresponds to the running mode shown in FIG. 11.

Conversely, if it is desired to decrease the compression ratio either from the position obtained before or from the nominal position, an action as shown by arrow F'1 is exerted on bar 150. The effect of this action is to cause the eccentrics to revolve around axis Z"Z" in a clockwise direction while displacing bores 146 in the same direction and by driving the entire lever away from the fixed point. Height H" of axis ZZ of pivot 46 is therefore at a greater distance H" than height H or height H'. This position corresponds to the diagrams of FIG. 12 for which the operation applies.

The present invention is not limited to the example described above and it encompasses any variant or equivalent.

While, it has been described for the displacement variation as well as the compression ratio variation that the pivot is always in extreme positions such as, for example, in the case of FIGS. 4 to 9, resting against the ends of opening 44, the pivot may occupy all the positions between its nominal position and the extreme positions so as to be able to achieve a multiplicity of engine displacement and/or compression ratio variations.

The invention claimed is:

1. An internal-combustion engine including at least one cylinder in which a piston slides between top dead center and bottom dead center under action of a connecting rod of an axis and a crankshaft controlling displacement of the piston under an effect of an articulated linking system allowing variation of the engine displacement and/or compression ratio, the articulated linking system comprising a shift lever mounted to pivot around an articulation axle and displaceable in translation in at least one direction by displacement control means, the shift lever comprising an opening within which the axle is housed and is connected by one end thereof to the connecting rod and by another end to a link connected to the crankshaft, wherein the shift lever comprises a slider carrying the articulation axle and cooperating with an opening of the shift lever.

2. An internal-combustion engine as claimed in claim 1, comprising means for controlling the displacement in translation of the shift lever in a first direction and by the displacement control means for controlling the displacement in translation of the shift lever in a direction orthogonal to the first direction.

3. An internal-combustion engine as claimed in claim 2, wherein the displacement means comprise a jack and rod.

4. An internal-combustion engine as claimed in claim 3, wherein the displacement control means comprise an eccentric carrying a bore receiving the articulation axle.

5. An internal-combustion engine as claimed in claim 2, wherein a longitudinal axis of the connecting rod and a longitudinal axis of the shift lever form a non-zero angle.

6. An internal-combustion engine as claimed in claim 2, wherein the displacement control means comprise an eccentric carrying a bore receiving the articulation axle.

7. An internal-combustion engine as claimed in claim 1, wherein the articulation axle is displaceable in translation in a direction orthogonal to the first direction of the shift lever.

8. An internal-combustion engine as claimed in claim 7, wherein the shift lever comprises means for locking the translation of articulation axle in the opening.

9. An internal-combustion engine as claimed in claim 8, wherein the displacement control means comprise an eccentric carrying a bore receiving the articulation axle.

10. An internal-combustion engine as claimed in claim 7, wherein a longitudinal axis of the connecting rod and a longitudinal axis of the shift lever form a non-zero angle.

11. An internal-combustion engine as claimed in claim 7, wherein the displacement control means comprise an eccentric carrying a bore receiving the articulation axle.

12. An internal-combustion engine as claimed in claim 1, wherein the shift lever comprises inclined grooves cooperating with projections carried by the articulation axle and running across the slider through slots.

13. An internal-combustion engine as claimed in claim 12, wherein the displacement control means comprise an eccentric carrying a bore receiving the articulation axle.

14. An internal-combustion engine as claimed in claim 1, wherein the displacement control means comprise an eccentric carrying a bore receiving the articulation axle.

15. An internal-combustion engine as claimed in claim 14, wherein the displacement control means comprises eccentrics arranged in parallel relative to each other and between which the shift lever is placed with the articulation axle.

16. An internal-combustion engine as claimed in claim 14, wherein the eccentric carries a means for controlling rotation around an axis thereof.

17. An internal-combustion engine as claimed in claim 16, wherein the means for controlling comprises an axial bar.

18. An internal-combustion engine as claimed in claim 14, wherein the displacement control means comprise an eccentric carrying a bore receiving the articulation axle.

19. An internal-combustion engine as claimed in claim 1, wherein a longitudinal axis of the connecting rod and a longitudinal axis of the shift lever form a non-zero angle.

20. A method of varying displacement and/or a compression ratio of an internal-combustion engine including at least one cylinder in which a piston slides between a top dead center and a bottom dead center under action of a connecting rod with an axis and a crankshaft controlling displacement of the piston under an effect of an articulated linking system, comprising providing the articulated linking system with a shift lever mounted pivotably around an articulation axle, for connecting the shift lever by one end thereof to the connecting rod and by another end to a link connected to the crankshaft, displacing in translation the shift lever in a first direction to modify shift lever arms in relation to the articulation axle in to change the displacement and/or displacing the shift lever in translation in a direction orthogonal to a first direction to modify the compression ratio, wherein displacing the shift lever in translation is in a vertical direction to change a height between the articulation axle and a fixed point of the engine to modify the engine compression ratio.

* * * * *